United States Patent [19]

Boyett, III et al.

[11] 4,079,540

[45] Mar. 21, 1978

[54] TOY BANK

[76] Inventors: Charles A. Boyett, III, P.O. Box 401, Anna Maria, Fla. 33501; H. Pat Sullivan, Lansing, N.C. 28643

[21] Appl. No.: 742,778

[22] Filed: Nov. 18, 1976

[51] Int. Cl.[2] ..... A63H 33/00

[52] U.S. Cl. ..... 46/4; 46/1 L

[58] Field of Search ..... 46/1 L, 2, 3, 4, 5

[56] References Cited

U.S. PATENT DOCUMENTS

| | | | |
|---|---|---|---|
| 232,512 | 9/1880 | Kyser et al. | 46/3 |
| 1,549,444 | 8/1925 | Buel | 46/3 |
| 2,448,951 | 9/1948 | Baum | 46/4 |
| 3,439,444 | 4/1969 | Smith | 46/2 |

*Primary Examiner*—Louis G. Mancene
*Assistant Examiner*—Mickey Yu
*Attorney, Agent, or Firm*—Stefan M. Stein; Robert F. Frijouf

[57] ABSTRACT

A toy bank device as disclosed for receiving and depositing coins comprising a base member adapted for location on a substantially horizontal surface and including base member mounting means. The base member has a base member orifice for receiving and storing coins within the base member. A support member has securing means which is cooperable with the base member mounting means for establishing the support to extend from the base member. A coin insertion member mounted relative to the support member is adapted to receive and mechanically insert the coin into the base member orifice. The coin insertion member may be movably mounted for inserting the coin into the base member orifice upon movement of the coin insertion member. Each of the aforementioned members may be a die cut portion of a paper material with each of the members having tab means and slit means for enabling assembly of the members into a substantially rigid structure through cooperation of the tab means and the slit means. Alternatively, each of the aforementioned members may comprise a plastic member having a plurality of locking means for enabling assembly of the members into an interlocking structure. The foregoing abstract is merely a resume of one general application, is not a complete discussion of all principles of operation or applications, and is not to be construed as a limitation on the scope of the claimed subject matter.

13 Claims, 33 Drawing Figures

TOY BANK

BACKGROUND OF THE INVENTION

1. Field of the Invention

This invention relates to banks and more particularly to toy bank devices for receiving and depositing coins within the bank device.

2. Description of the Prior Art

Toy banks have been known to the prior art for a great number of years and have exhibited various designs and constructions. Many of these prior art banks included novel means for inserting a coin within the bank. Many of these prior art devices included animals or human-like forms mounted for movement relative to the bank for inserting the coin within the bank. The fundamental theory behind the use of animals and humanlike forms is to interest children in the operative mechanism of the bank and thereby encourage the insertion of coins within the bank and accordingly develop a habit of saving money. One distinct disadvantage of these prior art mechanized banks was the complexity of the mechanism and construction of the coin inserter. These banks were expensive to manufacture and did not obtain widespread use in the art.

Others in the prior art have provided toy banks made of foldable sheet material such as cardboard for constructing a bank upon assembly of the cardboard member. Such a bank was easy to manufacture and distribute at a very reasonable cost but unfortunately lacked the interesting mechanism by which the coin is inserted within the bank. The prior art has failed in providing a low cost toy bank device which may be assembled and which incorporates a unique and interesting mechanism to insert a coin within the bank.

Therefore it is an object of this invention to provide an apparatus which overcomes the aforementioned inadequacies of the prior art devices and provides an improvement which is a significant contribution to the advancement of the pertinent art.

Another object of this invention is to provide a toy bank device for receiving and depositing coins comprising a base member and a support member securable to the base member and having coin insertion means mounted relative to the support member and adapted to receive the coin and mechanically insert the coin within the base member.

Another object of this invention is to provide a toy bank device for receiving and depositing coins constructed of plastic members having a plurality of locking means for enabling assembly of the members into an interlocking structure. Alternatively, the toy bank device may comprise a plurality of paper members having locking means for enabling assembly of the paper members into an interlocking structure.

Another object of this invention is to provide a toy bank device for receiving and depositing coins having a coin insertion member including a sloping surface established relative to the support member enabling the coin to move along the sloping surface by action of gravity to be inserted within the base member orifice and to portray the movement of a skier down a ski slope.

Another object of this invention is to provide a toy bank device for receiving and depositing coins having a coin insertion member which is pivotably mounted relative to a support member with the support member and the coin insertion member being established to represent the mouth of an animal which receives the coin.

Another object of this invention is to provide a toy bank device for receiving and depositing coins wherein the coin insertion member is pivotably mounted relative to the base member for inserting the coin within the base member with the coin insertion member being established to represent an animal such as a squirrel climbing up a tree for inserting the coin within the bank.

Another object of this invention is to provide a toy bank device for receiving and depositing coins wherein the coin insertion member is mounted for movement relative to the base member along a substantially linear portion and including a curved portion for tilting the coin insertion member at the end of the linear portion to insert the coin within the base member.

A further object of this invention is to provide a toy bank device for receiving and depositing coins wherein each of the constituent members is a die-cut portion of a paper, or plastic material with each of the members having tab means and slit means for enabling assembly of the members into a substantially rigid structure through cooperation of the tab means and the slit means.

Other objects of the invention will in part be obvious and will in part appear hereinafter.

SUMMARY OF THE INVENTION

The invention may be incorporated into a toy bank device for receiving and depositing coins comprising in combination a base member adapted for location on a substantially horizontal surface and including base member mounting means. The base member has a base member orifice for receiving and storing coins within the base member. A support member having securing means cooperates with the base member mounting means for establishing the support member to extend from the base member. A coin insertion member is mounted relative to the support member and adapted to receive a coin and mechanically insert the coin into the base member orifice. The coin insertion member may be movably mounted for inserting the coin into the base member orifice upon movement of the coin insertion member. The coin insertion member may further include a sloping surface established relative to the support member enabling the coin to move along the sloping surface by action of gravity to be inserted into the base member orifice. A receiver member comprising a receiver orifice may be secured relative to the base member and the coin insertion member for enabling insertion of the coin into the receiver orifice for transferring to the base member orifice. The coin insertion member may be pivotably mounted relative to one of the base and support members to pivotably insert the coin. The coin insertion member may be pivotably mounted relative to one of the base and support members and established to represent the mouth of an animal whereby the coin is inserted within the mouth. The support member and the coin insertion member may be established to represent a ski slope whereby an inserted coin rolls down the ski slope by action of gravity for insertion into the base member. The invention may include slot means in the support member extending longitudinally along at least a portion of the length of the base member for cooperation with projections in the coin insertion member for guiding the coin insertion member relative to the support member for inserting the coin within the base member. The slot means may have a curved portion for tilting the coin insertion member to insert the coin into the base member. Other embodiments may include the coin insertion member having a pivotable arm journalled relative to the base member and means for pivoting the coin insertion member to insert the coin within the base. A lever may be provided and secured relative to the coin insertion member extending to an exterior portion of the base member for moving the coin insertion member about the pivot point. The improved toy bank device may be fashioned of plastic members having a plurality of locking means for enabling assembly of the members into an interlocking structure. In the alternative, the toy bank may include a plurality of paper members having locking means for enabling assembly of the members into an interlocking structure. Each of the paper members may be a die-cut portion of a paper material. The pivotable mounting of the coin insertion member as heretofor described may be a shaft of a wood product such as a toothpick or a matchstick.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE DRAWINGS

Figure 1:
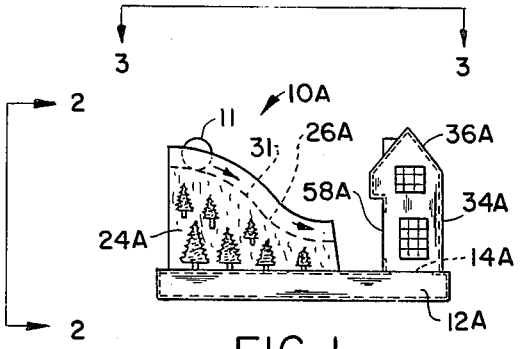
FIG. 1 is a side elevational view of a first embodiment of a toy bank.
Figure 2:
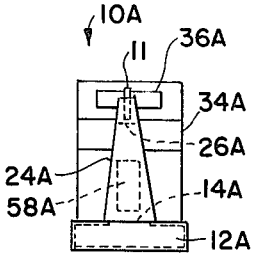
FIG. 2 is an end view along line 2—2 of the toy bank shown in FIG. 1.
Figure 3:
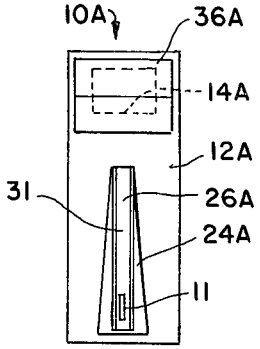
FIG. 3 is a top view along line 3—3 of the toy bank shown in FIG. 1.

FIGS. 1–3 illustrate a first embodiment of a toy bank 10A comprising a base member 12A having a base member orifice 14A for receiving a coin 11 within the base member 12A. FIGS. 13–17 illustrate constituent members of the toy bank 10A shown in FIGS. 1–3. The constituent members shown in FIGS. 13–17 may be die-cut paper or plastic members wherein the solid lines indicate die-cut portions and the dashed lines indicate portions upon which folds are to be made. Unless specified, the folds are considered to be perpendicular folds. The base member may be fashioned into a substantially rectangular structure by folding the device on the lines as indicated with tabs 16A cooperating with slits 18A to form a substantially rigid member.

Figure 14:
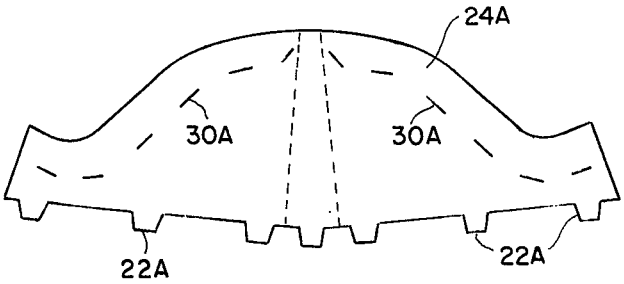
FIG. 14 is a support member for the invention shown in FIGS. 1–3.

The base member 12A includes mounting means 20A shown as a plurality of slits cooperable with tabs 22A of an upwardly extending support member 24A shown in greater detail in FIG. 14. A coin insertion member 26A in FIG. 15 has a plurality of tabs 28A which are cooperable with slits 30A in support member 24A for forming a sloping surface 31 for guiding the coin 11 down the sloping surface 31 for insertion within the base member orifice 14A.

Figure 17:
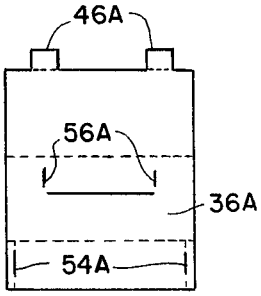
FIG. 17 is a second portion of a receiver member for the invention shown in FIGS. 1–3.
Figure 16:
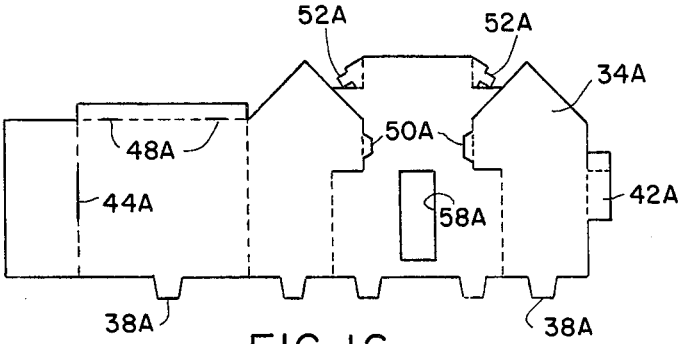
FIG. 16 is a first portion of a receiver member for the invention shown in FIGS. 1–3.
Figure 15:
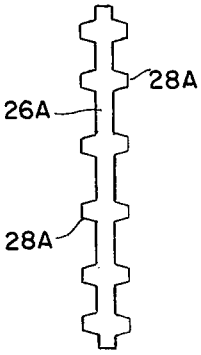
FIG. 15 is a coin insertion member for the invention shown in FIGS. 1–3.

The invention also comprises a first and a second receiver member 34A and 36A shown in FIGS. 16 and 17 respectively. The first receiver member 34A has tabs 38A cooperable with slits 40A in the base member 12A for mounting the first receiver member 34A to the base member 12A. The first receiver member 34A includes a tab 42A cooperable with a slit 44A for forming a house-like structure. The second receiver member 36A comprises the roof of the house structure with tabs 46A cooperating with slits 48A and with tabs 50A and 52A of the first receiver member 34A cooperating with slits 54A and 56A respectively for forming the structure shown in FIGS. 1–3. Obviously some of the folds of the second receiver member 36A are not perpendicular.

The first receiver member 34A includes a receiver orifice 58A for receiving the inserted coin.

FIGS. 1-3 illustrate that the toy bank 10A is established with the sloping surface 31 representating a ski slope. When the coin 11 is inserted on the upper portion of the sloping surface 31 the coin 11 moves in the direction shown by the arrows by action of gravity to enter the receiver member orifice 58A and to subsequently enter base member orifice 14A. The side portion of the support member 24A and may be decorated as a ski slope with trees as shown whereas receiver member 34A and 36A may be decorated as a ski house or the like.

Figure 4:
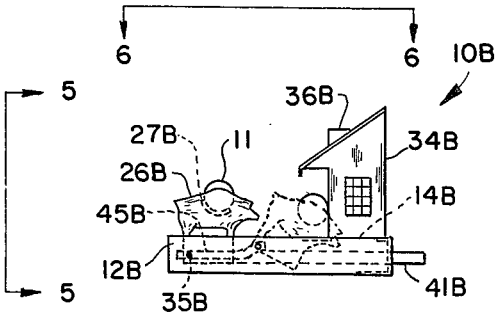
FIG. 4 is a side elevational view of a second embodiment of a toy bank.
Figure 5:
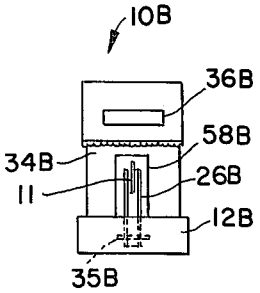
FIG. 5 is an end view along line 5—5 of the toy bank shown in FIG. 4.
Figure 6:
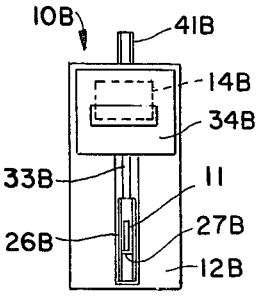
FIG. 6 is a top view along line 6—6 of the toy bank shown in FIG. 4.
Figure 18:
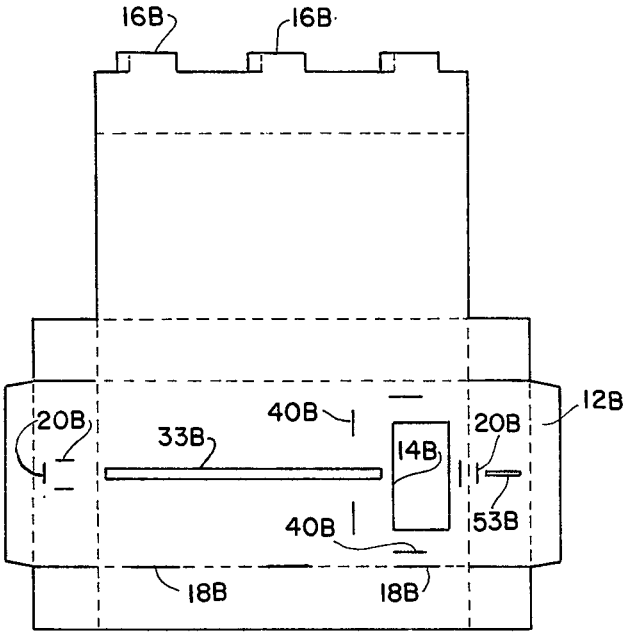
FIG. 18 is a base member for the invention shown in FIGS. 4–6.
Figure 20:
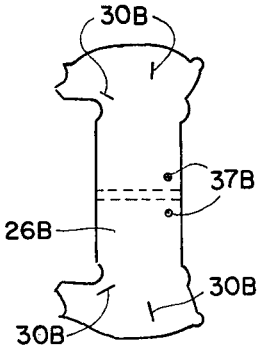
FIG. 20 is a first portion of coin inserting means for the invention shown in FIGS. 4–6.
Figure 21:
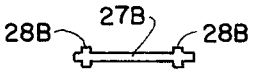
FIG. 21 is a second portion of coin inserting means for the invention shown in FIGS. 4–6.
Figure 22:
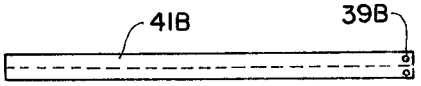
FIG. 22 is a lever member cooperable with the coin inserting means shown in FIGS. 20 and 21 for the invention shown in FIGS. 4–6.
Figure 23:
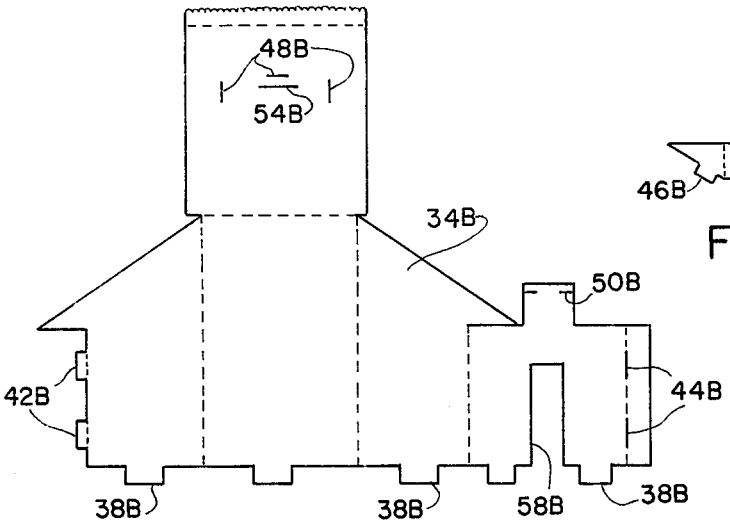
FIG. 23 is a first portion of a receiver member for the invention shown in FIGS. 4–6.
Figure 24:
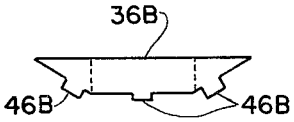
FIG. 24 is a second portion of a receiver member for the invention shown in FIGS. 4–6.
Figure 19:
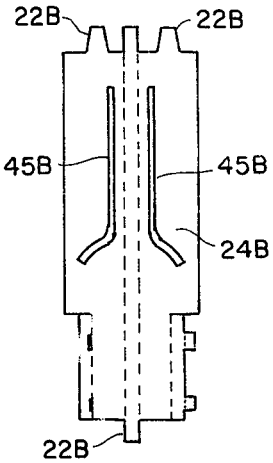
FIG. 19 is a support member for the invention shown in FIGS. 4–6.
Figure 25:
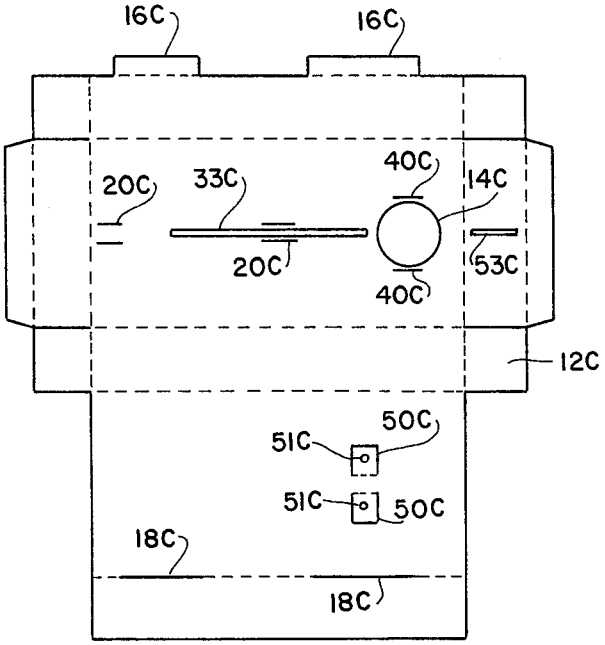
FIG. 25 is a base member for the invention shown in FIGS. 7–9.
Figure 30:
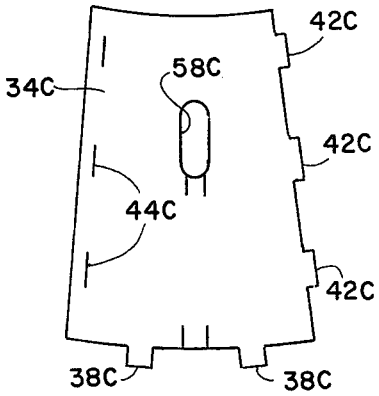
FIG. 30 is a coin receiving member for the invention shown in FIGS. 7–9.

FIGS. 4-6 illustrate side, end, and top elevational views of a second embodiment of a toy bank 10B. Constituent members of the bank 10B are shown in FIGS. 18-24. Similar parts for each of the four embodiments of the toy banks 10A-10D have identical reference numerals with different alphabetical indicia (A, B, C, D), respectively. A base member 12B shown in FIG. 18 is similar to the base member 12A having a base member orifice 14B and tabs 16B cooperable with slits 18B to form the base member 12B. Mounting means including slits 20B cooperate with tabs 22B of a support member 24B shown in FIG. 19 to extend from and within the base member 12B. In this embodiment, the member 24B is folded upon itself and secured by integral tabs and slits but it is understood that a single piece of heavier material such as plastic or cardboard may also be used in this construction. Coin insertion member 26B in FIG. 20 cooperates with a coin holder 27B in FIG. 21 with tabs 28B being received by slits 30B to hold the coin 11 as shown in FIGS. 4-6. The coin insertion member 26B extends through a slot 33B in the base member 12B with a pin 35B shown in FIGS. 4 and 5 extending through apertures 37B of the coin insertion member 26B and apertures 39B in a lever 41B shown in FIG. 22. The pin 35B extends within slots 45B of the support member 24B. A first receiver member 34B shown in FIG. 23 is cooperable through tabs 38B into slits 40B of base member 12B to form an upright structure with tabs 42B being insertable within slits 44B to form a house-like structure. Tab 50B is insertable within slit 54B. A second receiver member 36B shown in FIG. 24 has tabs 46B insertable into slits 48B of the first receiver member 34B. Obviously, many of the roof folds are not perpendicular folds.

In this embodiment, the coin insertion member 26B is fashioned in the general shape of a pig with the first and second receiver members 34B and 36B being fashioned in the general shape of a house. Movement of the lever 41B extending through slot 53B causes substantially linear movement of the coin insertion member 26B to the right in FIG. 4 with pin 35B following the contour of slots 45B. The coin insertion member 26B tips in a clock-wise direction for inserting the coin 11 through a receiver orifice 58B when pin 35B follow the portion of slot 45B having a vertical component. The tipping coin insertion member 26B is shown in phantom.

Figure 7:
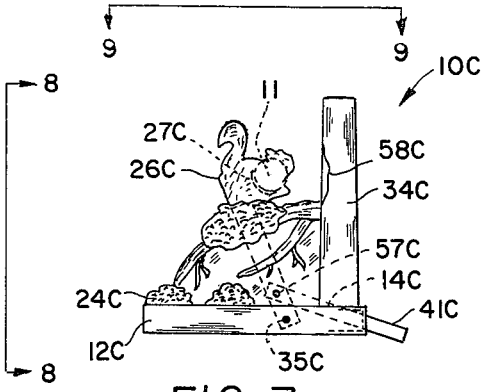
FIG. 7 is a side elevational view of a third embodiment of a toy bank.
Figure 8:
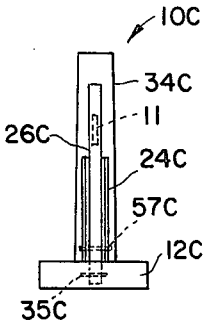
FIG. 8 is a end view along line 8—8 of the toy bank shown in FIG. 7.
Figure 9:
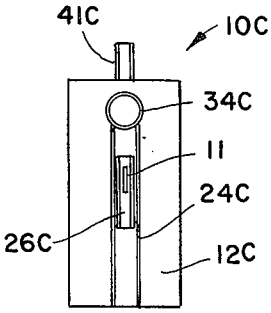
FIG. 9 is a top view along line 9—9 of the toy bank shown in FIG. 7.
Figure 26:
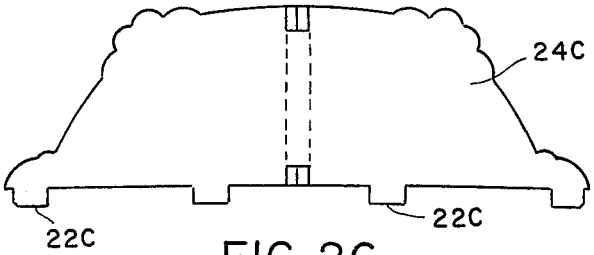
FIG. 26 is a support member for the invention shown in FIGS. 7–9.
Figure 27:
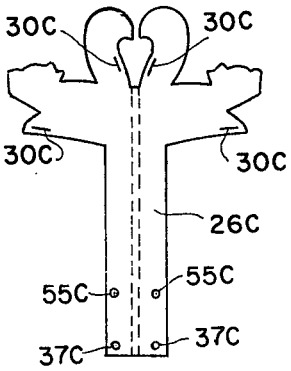
FIG. 27 is a first portion of coin inserting means for the invention shown in FIGS. 7–9.
Figure 29:
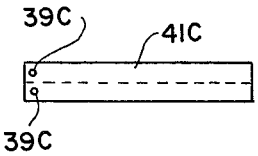
FIG. 29 is a lever cooperable with the coin inserting means shown in FIGS. 27 and 28.
Figure 28:
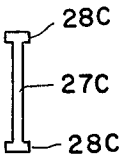
FIG. 28 is a second portion of coin inserting means for the invention shown in FIGS. 7–9.

FIGS. 7-9 illustrate side, end and top elevational views of a third embodiment of the toy bank 10C. Constituent members of the bank 10C are illustrated in FIGS. 25-30. The bank 10C comprises a base member 12C which may be formed in the shape of a rectangular prism by the insertion of tabs 16C within slits 18C. A support member 24C shown in FIG. 26 is mounted to the base member 12C shown in FIG. 26 is mounted to the base with tabs 22C. A coin insertion member 26C in FIG. 27 receives a coin holder 27C of FIG. 28 with tabs 28C cooperating with slits 30C in the coin insertion member 26C. A slot 33C in the base member 12C receives a lever portion of the coin insertion member 26C. Apertures 37C of member 26C cooperate with apertures 51C of support tabs 50C of the base member 12C to enable pivotable movement of the coin insertion member 26C about a pivot pin 35C. A lever 41C shown in FIG. 29 having apertures 39C is cooperable with apertures 55C in member 26C through a pin 57C. A first receiver member 34C shown in FIG. 30 having a receiver orifice 58C is securable to the base member 12C through tabs 38C cooperating with slits 40C. Tabs 42C cooperate with slits 44C to form a tree trunk shaped member.

Lever 41C extends through slot 53C to enable activation of the bank device 10C. Pulling lever 41C to the right in FIG. 7 causes a clock-wise rotation of coin insertion member 26C about pin 35C for inserting the coin 11 in the aperture 58C of the first receiving member 34C to subsequently fall through the base member orifice 14C. In this embodiment, the coin insertion member is shaped in the general shape of a squirrel. The movement of lever 41C to the right in FIG. 7 causes the squirrel to climb and insert the coin within a trunk of a tree depicted by the first receiving member 34C.

Figure 10:
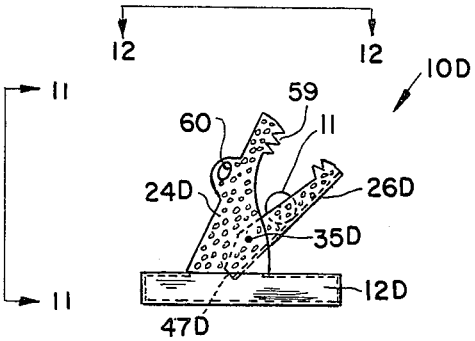
FIG. 10 is a side elevational view of a fourth embodiment of a toy bank.
Figure 11:
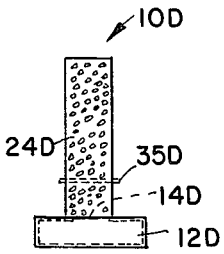
FIG. 11 is an end view along line 11—11 of the toy bank shown in FIG. 10.
Figure 12:
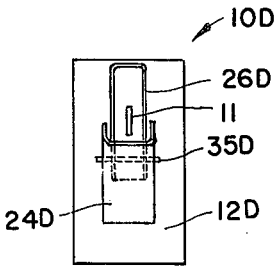
FIG. 12 is a top view along line 12—12 of the invention shown in FIG. 10.
Figure 13:
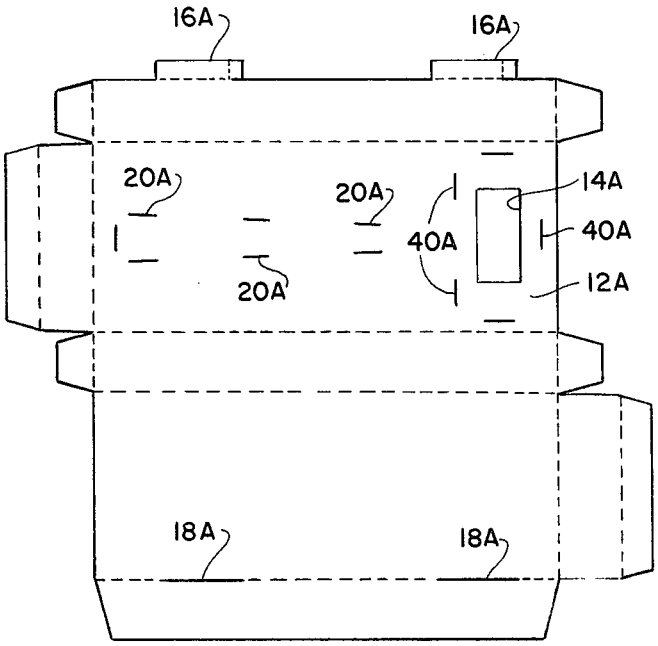
FIG. 13 is a base member for the toy bank shown in FIGS. 1–3.
Figure 32:
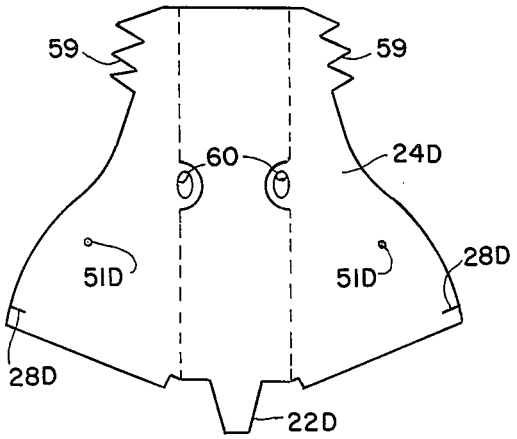
FIG. 32 is a support member for the invention shown in FIGS. 10–12.
Figure 33:
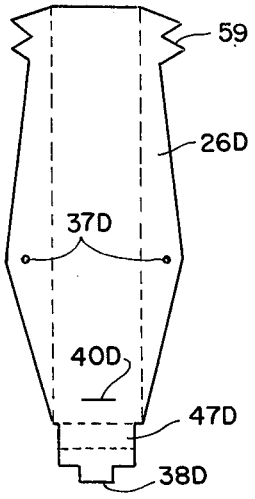
FIG. 33 is a coin insertion member cooperable with the support member and base member for the invention shown in FIGS. 10–12.
Figure 31:
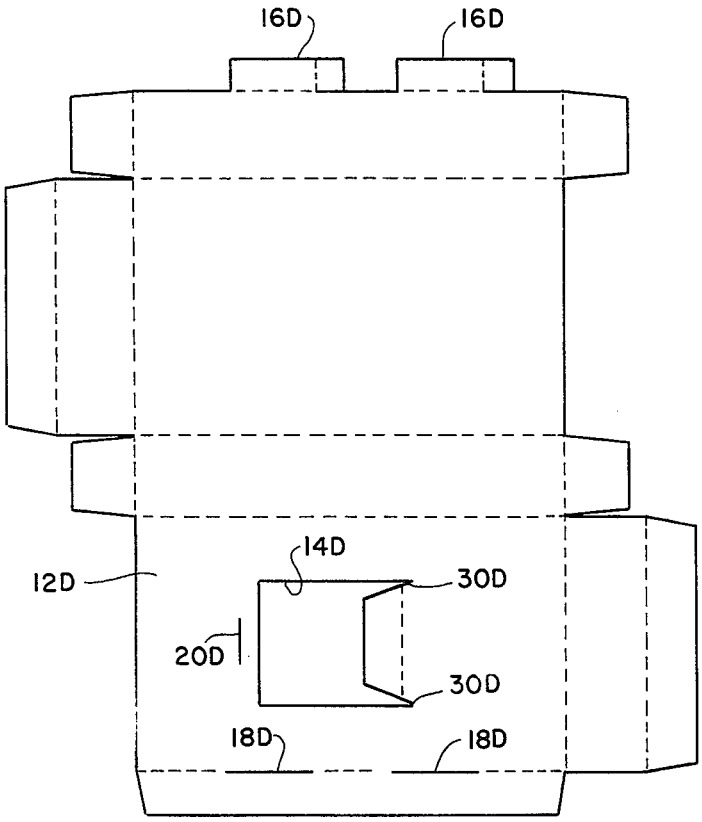
FIG. 31 is a base member for the invention shown in FIGS. 10–12.

FIGS. 10-12 illustrate side, end and top views of a fourth embodiment of a toy bank 10D. FIGS. 31, 32 and 33 show a base member 12D, a support member 24D and a coin insertion member 26D similar to the first three embodiments 10A, 10B and 10C of this invention. Base member tabs 16D cooperate with slits 18D to form the base member 12D. The remaining extending tabs fold as a conventional cardboard box. Tab 22D cooperates with slit 20D in addition tabs 28D cooperating with slits 30D to secure the support member 24D to be located over the base member orifice 14D. A tab 38D is insertable within a slit 40D in the coin insertion member 26D to form a bottom surface 47D of the coin insertion member 26D. The bottom surface 47D is established to be generally perpendicular to a coin receiving surface or the inner surface of coin insertion member 26D. Apertures 37D in the coin insertion member 26D cooperate with apertures 51D through a pin 35D made of a wooden product such as a match stick or a toothpick. Pin 35D enables pivoting the coin insertion member 26D relative to the support member 24D. The coin insertion member 26D and a support member 24D may be fashioned as shown with teeth 59 and eyes 60 for representing the mouth of an animal. Accordingly, upon insertion of a coin 11 into the mouth of an animal, the coin will fall by action of gravity along the coin receiving surface into the open mouth of the animal until it strikes the back surface 47D whereby the mouth will close and a coin drops through base member orifice 14D into the base member 12D.

The invention has been shown in four embodiments of toy banks 10A-10D which may be manufactured of many materials including die-cut plastic or paper material. The drawings have been shown to be suitable for a thin material which may be folded upon itself in many instances but it is understood that such folds may be eliminated by the use of a single member. The levers 41B and 41C in addition to the coin insertion members 26B and 26C are examples of these members. Pins 35B-35D have been disclosed as wooden products such as matchsticks or toothpick but it is understood that any suitable material such as plastic or metal may also be used in the construction. Many variations of tab location and connection and interchanging of tabs and slits may be incorporated within the construction of the embodiments herein presented without departing from the invention.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

Now that the invention has been described;

We claim:

1. A toy bank device for receiving and depositing coins comprising in combination:

a base member adapted for location on a substantially horizontal surface and including base member mounting means;

said base member having a base member orifice for receiving and storing coins within said base member;

a receiver member comprising a receiver orifice located on a lateral surface of said receiver member, means for securing said receiver member to extend upwardly from said base member;

a support member having securing means cooperable with said base member mounting means for establishing said support member to extend from said base member; and a coin insertion member mounted relative to said support member adapted to receive a coin and mechanically insert the coin into said receiver orifice for transfer to said base member orifice.

2. A device as set forth in claim 1, wherein said coin insertion member includes a sloping surface established relative to said support member enabling the coin to move along said sloping surface by action of gravity to be inserted into said receiver orifice.

3. A device as set forth in claim 1, wherein said coin insertion member is pivotably mounted relative to one of said base and said support members to pivotably insert the coin.

4. A device as set forth in claim 1, wherein said receiver member is established to represent a dwelling house with said receiver orifice being a door thereof; and said support member and said coin insertion member being established to represent a ski slope whereby an inserted coin rolls down said ski slope by action of gravity to enter said door of said dwelling house.

5. A device as set forth in claim 1, wherein said coin insertion member includes a pivotable arm journalled relative to said base member; and means for pivoting said coin insertion member to insert the coin into said receiver orifice.

6. A device as set forth in claim 1, wherein said coin insertion member is movably mounted relative to said base member; and a lever secured relative to said coin insertion member and extending to an exterior portion of said base member for moving said coin insertion member about said axis means.

7. A device as set forth in claim 1, wherein each of said members is a plastic member having a plurality of locking means for enabling assembly of said members into an interlocking structure.

8. A device as set forth in claim 1, wherein each of said members is a paper member having a plurality of locking means for enabling assembly of said members into an interlocking structure.

9. A device as set forth in claim 1, wherein each of said members is die cut portion of a paper material with each of said members having tab means and slit means for enabling assembly of said members into a rigid structure through cooperation of said tab means and said slit means.

10. A device as set forth in claim 1, wherein said coin insertion member is pivotably mounted by a shaft of a wood product.

11. A toy bank device for receiving and depositing coins comprising in combination:

a base member adapted for location on a substantially horizontal surface and including base member mounting means;

said base member having a base member orifice for receiving and storing coins within said base member;

a support member having securing means cooperable with said base member mounting means for establishing said support member to extend from said base member;

slot means in said support member extending longitudinally along at least a portion of the length of said base member;

a coin insertion member mounted relative to said support member adapted to receive a coin and mechanically insert the coin into said base member orifice; and said coin insertion member having projections cooperating with said slot means for guiding said coin insertion member relative to said support member for inserting the coin into said base member orifice.

12. A device as set forth in claim 11, wherein said slot means has a curved portion for tilting said coin insertion member to insert the coin into said base member orifice.

13. A toy bank device for receiving and depositing coins comprising in combination:

a base member adapted for location on a substantially horizontal surface and including base member mounting means;

said base member having a base member orifice for receiving and storing coins within said base member;

a support member having securing means cooperable with said base member mounting means for establishing said support member to extend upwardly from said base member;

a coin insertion member pivotably mounted relative to said support member adapted to receive a coin and mechanically insert the coin into said base member orifice;

means establishing said support member and said coin insertion member to represent the mouth of an animal whereby the coin is inserted within the open mouth of the animal, and a back surface extending generally perpendicular to a coin receiving surface of said coin insertion member; whereby a coin falling along said coin receiving surface by action of gravity into the open mouth of the animal strikes said back surface to close the mouth of the animal.

* * * * *